US009962310B1

(12) United States Patent
Wright et al.

(10) Patent No.: US 9,962,310 B1
(45) Date of Patent: May 8, 2018

(54) STRETCHING APPARATUS

(71) Applicants: Warren J Wright, Miami, FL (US); Virgilio Blasco, Miami, FL (US)

(72) Inventors: Warren J Wright, Miami, FL (US); Virgilio Blasco, Miami, FL (US)

( * ) Notice: Subject to any disclaimer, the term of this patent is extended or adjusted under 35 U.S.C. 154(b) by 0 days. days.

(21) Appl. No.: 15/782,884

(22) Filed: Oct. 13, 2017

Related U.S. Application Data

(63) Continuation of application No. 15/727,259, filed on Oct. 6, 2017.

(51) Int. Cl.

| | |
|---|---|
| ***A63B 21/068*** | (2006.01) |
| ***A61H 1/02*** | (2006.01) |
| ***A61H 1/00*** | (2006.01) |
| *A63B 23/00* | (2006.01) |
| *A63B 23/02* | (2006.01) |
| *A63B 21/00* | (2006.01) |

(52) U.S. Cl.
CPC ..... *A61H 1/02* (2013.01); *A61H 1/006* (2013.01); *A63B 21/157* (2013.01); *A63B 21/4035* (2015.10); *A63B 23/0238* (2013.01); *A63B 2023/006* (2013.01); *A63B 2210/00* (2013.01); *A63B 2210/50* (2013.01)

(58) Field of Classification Search
CPC .. A61H 1/02; A61H 1/006; A61H 2201/1635; A61H 2201/0161; A63B 2023/006; A63B 23/0238; A63B 2210/50–2210/58; A63B 21/04; A63B 21/0442; A63B 21/08; A63B 21/16; A63B 21/4021; A63B 21/4033; A63B 21/4035; A63B 23/14; A63B 21/015; A63B 21/153; A63B 21/00185; A63B 21/4049; A63B 21/0157; A63B 23/0211; A63B 23/1227; A63B 23/1236; A63B 2210/00
See application file for complete search history.

(56) References Cited

U.S. PATENT DOCUMENTS

| | | | | |
|---|---|---|---|---|
| 3,893,667 A * | 7/1975 | Snyder, Jr. | ..... | A63B 21/018 297/118 |
| 3,995,853 A * | 12/1976 | Deluty | ..... | A63B 21/015 482/116 |
| 4,205,839 A | 6/1980 | Best | | |
| 4,277,062 A | 7/1981 | Lawrence | | |
| 4,445,684 A | 5/1984 | Ruff | | |
| 4,456,247 A | 6/1984 | Ehrenfried | | |
| 4,478,413 A * | 10/1984 | Siwula | ..... | A63B 21/153 482/123 |

(Continued)

*Primary Examiner* — Gregory Winter

(57) ABSTRACT

An apparatus for stretching includes a base element, a housing, a strap element, and a ratcheting element. The housing has a strap egress, a first handle, and a second handle. The strap element has a first end and a second end, where the first end is coupled with the base element and the second end is mounted on a rotating element within the housing, such that the strap element can move in and out of the egress. The ratcheting element is for decreasing an exposed length of the strap between the base element and the housing by rotating one of the handles in a first direction. The base element has a diameter that is adjustable between an operating configuration and a stored configuration. The base element forms a planar surface when in the operating configuration and holds the housing above the planar surface when the base element is in the stored configuration.

18 Claims, 18 Drawing Sheets

(56) References Cited

U.S. PATENT DOCUMENTS 4,588,186 A 5/1986 Calabrese
4,819,936 A 4/1989 Muller
5,004,228 A 4/1991 Powers
5,026,049 A 6/1991 Goodman
5,067,709 A 11/1991 Christianson
5,234,396 A 8/1993 Wilkinson
5,261,865 A 11/1993 Trainor
5,312,309 A * 5/1994 Fox ..... A63B 21/0004 482/120
5,356,362 A 10/1994 Becker et al.
5,401,034 A * 3/1995 Mallinger ..... A63B 21/153 473/576
5,584,756 A 12/1996 Grapengiser
5,595,559 A 1/1997 Viel
5,611,770 A 3/1997 Tesch
5,662,592 A 9/1997 Brady
5,704,847 A * 1/1998 Glennon ..... A63B 55/10 473/282
5,860,897 A * 1/1999 Gilbert ..... A63B 21/055 482/123
5,895,342 A * 4/1999 Solland ..... A63B 21/0615 482/95
5,938,573 A 8/1999 Davies et al.
5,984,845 A 11/1999 Powers
6,203,473 B1 3/2001 Atwood
6,352,495 B1 3/2002 Hsu
6,422,981 B1 7/2002 Riser
6,634,995 B1 10/2003 Reed
6,656,094 B2 12/2003 Rigas
7,014,062 B2 3/2006 Yamauchi
7,223,212 B2 5/2007 DiOrio et al.
7,270,628 B2 9/2007 Campanaro
7,294,100 B2 11/2007 Bull
7,309,305 B2 12/2007 Nichols
7,476,182 B2 1/2009 DeNisco
7,833,141 B2 * 11/2010 Kulka ..... A63B 21/153 482/121
7,841,973 B2 11/2010 Trancart et al.
7,878,961 B2 2/2011 Carlucci et al.
7,946,971 B2 5/2011 Conley et al.
8,029,425 B2 10/2011 Bronston et al.
8,092,354 B2 1/2012 Oller, Jr.
8,251,880 B2 8/2012 Hampton
8,500,613 B2 8/2013 Eddy
8,622,880 B1 1/2014 Collett
8,641,582 B2 2/2014 Ahmadi Mirghaed
8,764,617 B2 7/2014 Teeter
2004/0029689 A1 2/2004 Contreras
2007/0087920 A1 * 4/2007 Dachraoui ..... A63B 21/0552 482/123
2009/0036276 A1 * 2/2009 Loach ..... A63B 21/15 482/72
2009/0105052 A1 4/2009 Dalebout et al.
2010/0152003 A1 6/2010 Haas
2012/0245004 A1 * 9/2012 Bremer ..... A63B 21/00185 482/129
2013/0090216 A1 * 4/2013 Jackson ..... A63B 21/018 482/52
2014/0155232 A1 * 6/2014 Wolan ..... A63B 21/0442 482/123
2016/0144217 A1 * 5/2016 Oltorik, Jr. ..... A63B 21/0442 482/130
2016/0256344 A1 9/2016 Lee
2016/0271444 A1 * 9/2016 Payne ..... A63B 23/1236

* cited by examiner

SECTION C-C
SCALE 1 : 5

STRETCHING APPARATUS

CROSS-REFERENCE TO RELATED APPLICATIONS

This application claims the benefit of the filing date of U.S. Non-Provisional application Ser. No. 15/727,259 titled "STECHING APPARATUS" and filed Oct. 6, 2017, now abandoned, and the subject matter of which is incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The present invention relates to the field of apparatuses used for physical activity, and more specifically to the field of stretching.

BACKGROUND

Stretching is a very important activity to maintain a person's health and proper body functions. Stretching before and after physical activity, such as working out or playing sports, will not only improve performance in that physical activity, but will help prevent injuries. Not only does stretching improve flexibility, range of motion and prevent injury, stretching increases blood flow, relieves stress, ensures correct posture, increases stamina, reduces muscle soreness, improves energy, and improves athletic performance. Additionally, performing stretches while standing provides further benefits, as you are engaging many muscles throughout your body. Benefits from performing stretching while standing include increased stability and balance, as well as muscle toning and strength increases.

One stretch in particular, bending at the waist to touch the toes, stretches the entire back of the body, especially the lower back and hamstrings, and can strengthen the thighs, knees and core. Bending at the waist to touch the toes is prevalent in activities that involve stretching, such as yoga, and many informally measure a person's flexibility by their ability to touch their toes. In light of this, many people would like to touch their toes, but cannot and require assistance to deepen their ability to stretch and ultimately touch their toes.

Devices exist to assist people in achieving deeper stretches. Information regarding relevant attempts to address these problems can be found in U.S. Pat. Nos. 6,634,995, 8,251,880, 6,656,094, 7,841,973, 8,622,880, 5,984,845, 7,309,305 and 8,092,354 and U.S. patent application Ser. Nos. 11/874,754 and 12/653,151. However, each one of these references suffers from one or more of the following disadvantages: (1) the device does not target the specific stretch of bending at the waist and touching the toes; (2) the device is not simple to use, (3) the device is not able to be set up easily and quickly; (4) the device is overly bulky, heavy and hard to transport; (5) the device is not able to be stored safely and easily; (6) the device uses electricity: or (7) the device is not self-contained.

As a result, there exists a need for improvements over the prior art and more particularly for a safe, simple, space-saving, easily accessible, easily movable, easily storable, non-electric apparatus for performing this type of stretching.

SUMMARY

An apparatus for stretching is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, an apparatus for stretching is disclosed. The apparatus comprises a base element, a housing, a strap element, and a ratcheting element. The housing has a strap egress, a first handle, and a second handle. The strap element has a first end and a second end, where the first end is coupled with the base element and the second end is mounted on a rotating element within the housing, such that the strap element can move in and out of the egress. The ratcheting element is for decreasing an exposed length of the strap between the base element and the housing by rotating one of the handles in a first direction. The base element has a diameter that is adjustable between an operating configuration and a stored configuration. The base element forms a planar surface when in the operating configuration and holds the housing above the planar surface when the base element is in the stored configuration.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, serve to explain the principles of the disclosed embodiments. The embodiments illustrated herein are presently preferred, it being understood, however, that the invention is not limited to the precise arrangements and instrumentalities shown, wherein.

DETAILED DESCRIPTION

Figure 1:
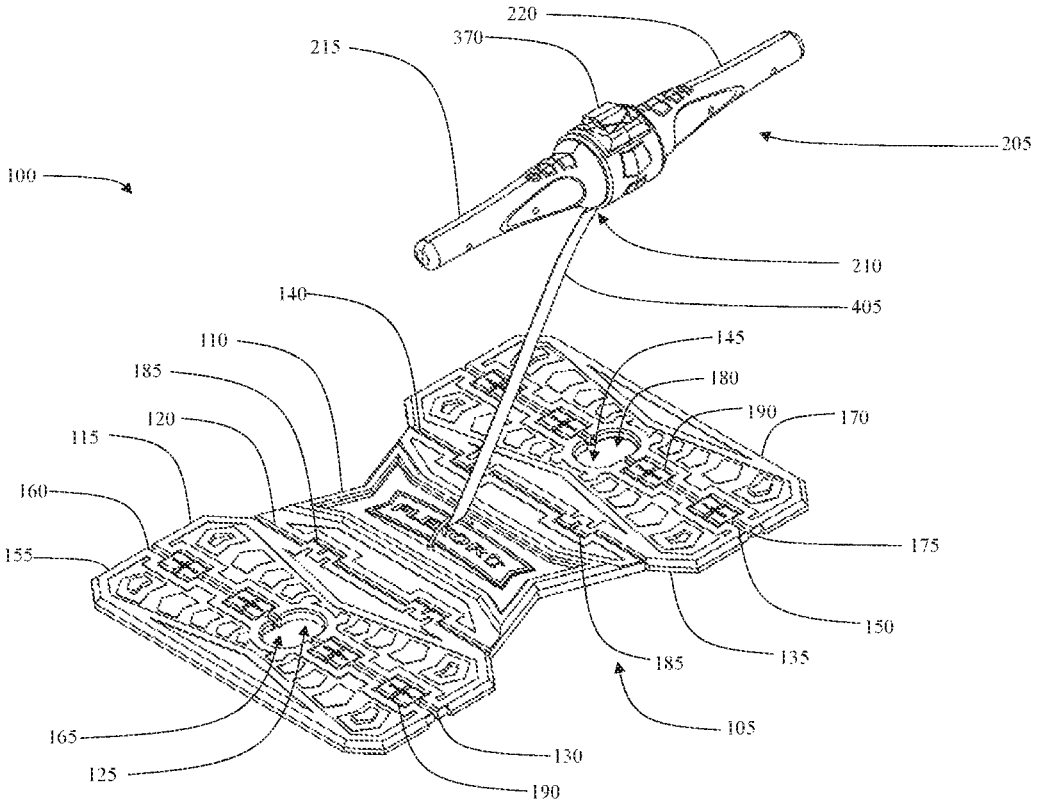
FIG. 1 is a front perspective view of the stretching apparatus in an operating configuration, according to an example of the embodiment.
Figure 2:
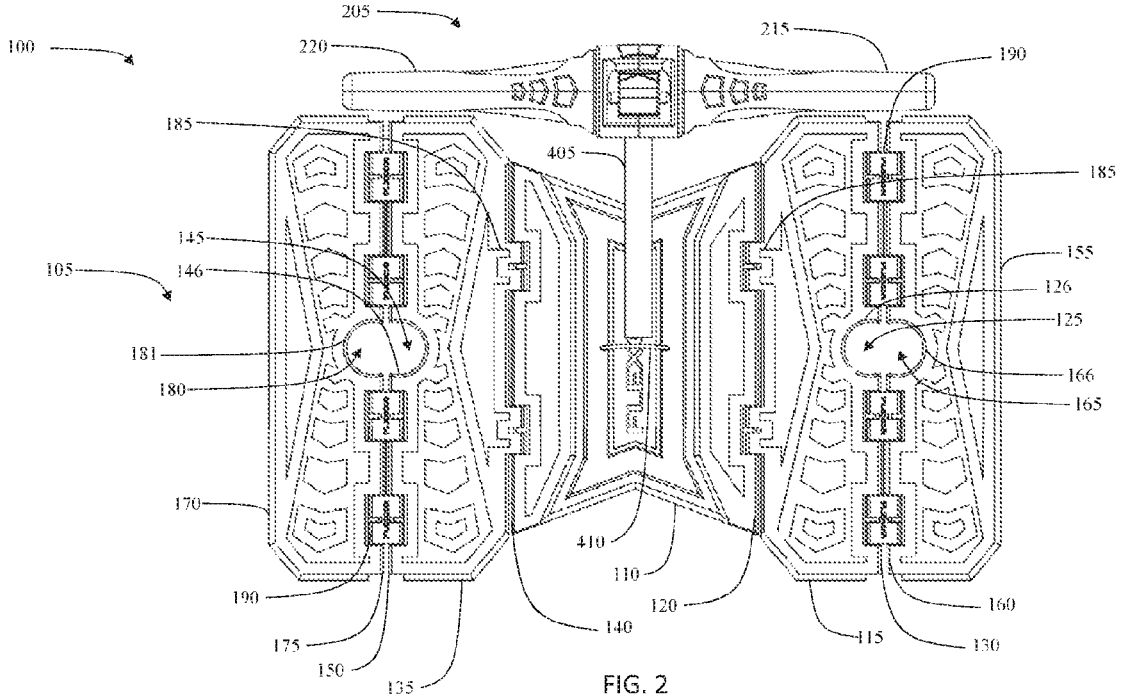
FIG. 2 is a top view of the stretching apparatus in an operating configuration, according to an example of the embodiment.
Figure 3:
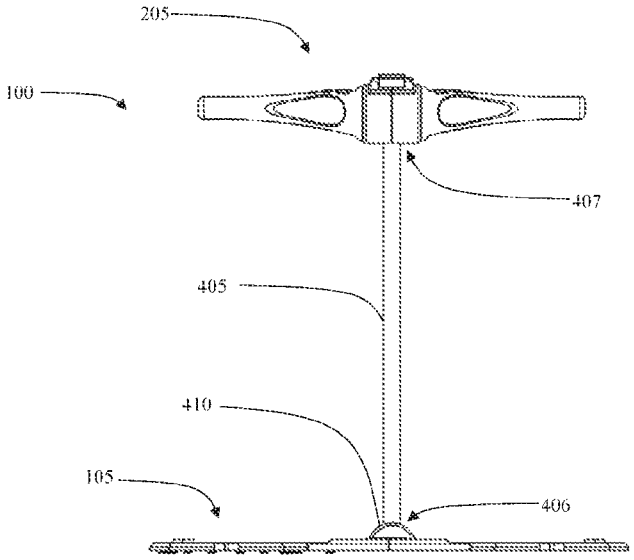
FIG. 3 is a rear view and FIG. 4 is a side view of the stretching apparatus in an operating configuration, according to an example of the embodiment.
Figure 4:
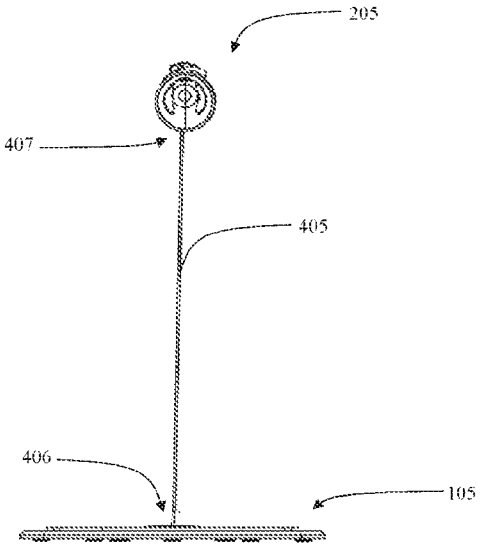

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions or modifications may be made to the elements illustrated in the drawings, and the methods described herein may be modified by substituting reordering, or adding additional stages or components to the disclosed methods and devices. Accordingly, the following detailed description does not limit the disclosed embodiments. Instead, the proper scope of the disclosed embodiments is defined by the appended claims.

The disclosed embodiments improve upon the problems with the prior art by providing a safe, simple, self-contained, space saving, easily accessible, easily movable, easily storable, non-electric apparatus for stretching. The disclosed embodiments are an improvement as the disclosed embodiments are simple and safe, as the disclosed embodiments target one specific stretch (bending at the waist to touch the toes), instead of many types of stretches, and allow the user to incrementally ease their body deeper into the stretch. The disclosed embodiments are also an improvement because the disclosed embodiments describe a simple, self-contained device in that the user only requires the disclosed embodiments to perform the stretch, as opposed to requiring further equipment or attaching the apparatus to some other structure, such as a wall or floor. The disclosed embodiments are space saving, easily movable and easily storable, as the disclosed embodiments are able to fold from an operating configuration to a smaller, easily storable configuration that saves space in the storable configuration. Furthermore, the device is easily storable as the depressions of the flaps of the base cradle the handle above the ground in the stored configuration, which protect the handles from damage.

Referring now to the Figures. FIGS. 1-4 depict the stretching apparatus 100 in an operating configuration. The stretching apparatus includes a base element 105, a housing 205, a strap element 405, and a ratcheting element 305. The housing defines a strap egress 210, a first handle 215 and a second handle 220. The strap element has a first end 406 and a second end 407. The first end is coupled with the base element, and the second end is mounted on a rotating element 360 (shown in FIG. 10) within the housing, such that the strap element can move in and out of the egress. The ratcheting element 305 (shown in FIG. 10) is for decreasing an exposed length of the strap 405 between the base element and the housing by rotating one of the handles in a first direction (described later).

Figure 5:
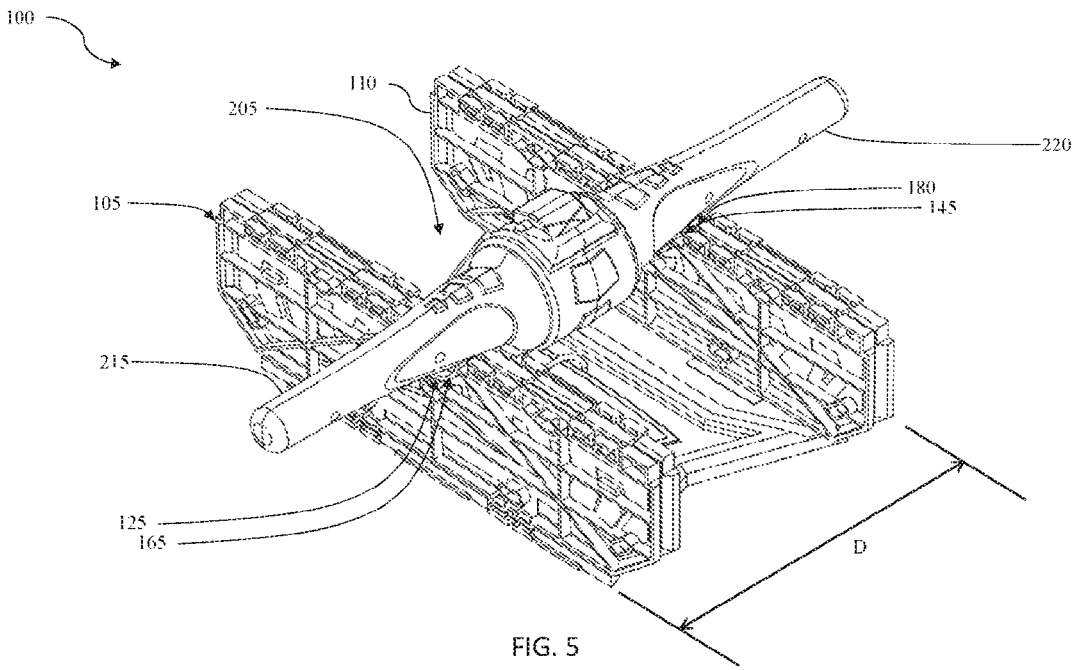
FIG. 5 is a front perspective view of the stretching apparatus in a stored configuration, according to an example of the embodiment.
Figure 6:
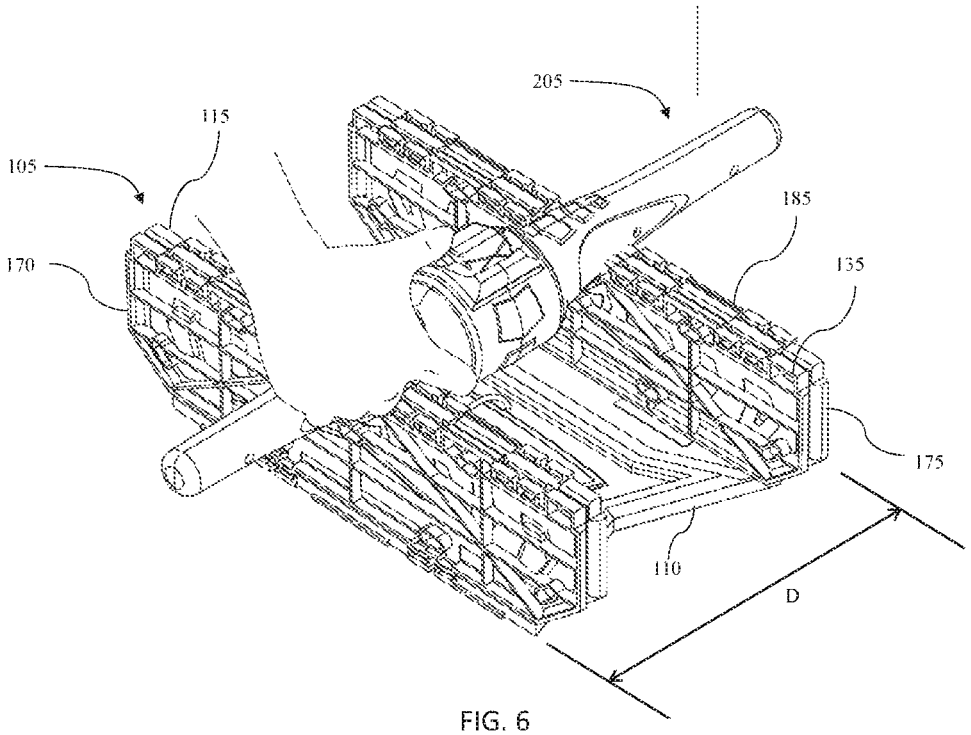
FIG. 6 is a front perspective view of a user moving the handle of the stretching apparatus from the stored configuration, according to an example of the embodiment.
Figure 7:
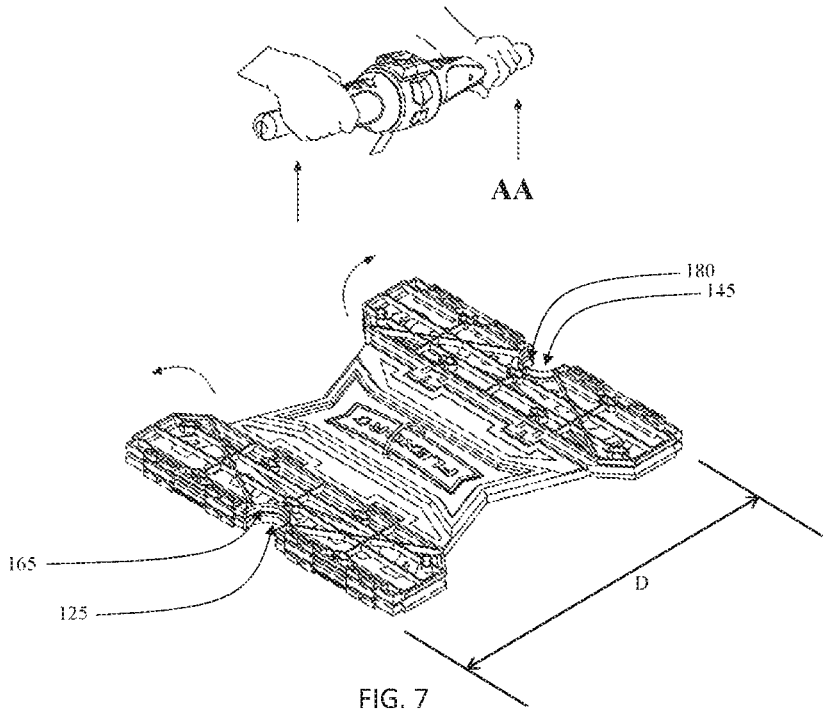
FIG. 7 is a front perspective view of a user moving the handle and opening the flaps of the stretching apparatus from the stored configuration to the operating configuration, according to an example of the embodiment.
Figure 8:
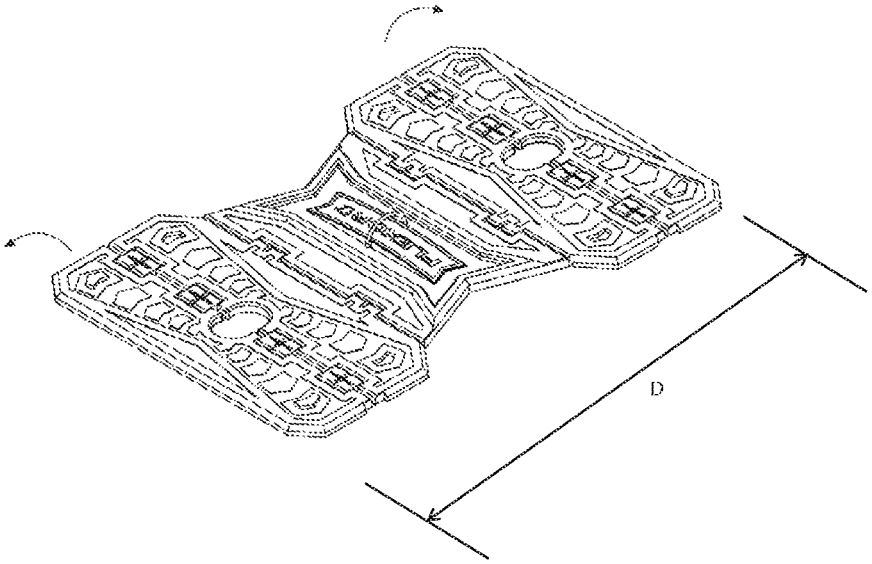
FIG. 8 is a front perspective view of a user opening the supplemental flaps of the stretching apparatus from the stored configuration to the operating configuration, according to an example of the embodiment.

FIG. 5 depicts the stretching apparatus 100 in a stored configuration and FIGS. 6-8 show the user moving the stretching apparatus from the stored configuration into the operating configuration. The base element 105 has a diameter D that is adjustable between an operating configuration (FIG. 8) and a stored configuration (FIG. 5). The base element 105 forms a planar surface when in the operating configuration and holds the housing 205 above the planar surface when the base element is in the stored configuration. The base element is where the user places their feet when using the stretching apparatus while in the operating configuration. In the embodiment shown, the base element contains a center element 110, a first flap 115, and a second flap 135. The first flap is hingedly coupled at hinge 185 with a first side edge 120 of the center element. The first flap has a curved feature 126, which defines a first depression 125 along an outward facing edge 130 of the first flap. The first depression cradles the first handle 215 when in the stored configuration. The second flap 135 is hingedly coupled at hinge 185 with a second side edge 140 of the center element. The second flap has a curved feature 146, which defines a second depression 145 along an outward facing edge 150 of the second flap. The second depression cradles the second handle 220 when in the stored configuration. When the user unfolds the first flap and second flap, this causes a second diameter (FIG. 7) of the base to be larger than the diameter of the base in the stored configuration (FIG. 5). In other words, if you compare diameter D of FIG. 7 and FIG. 5, the diameter in FIG. 7 is larger due to the flaps being opened.

In the embodiment shown, the base element also has a first supplemental flap 155 and a second supplemental flap 170. The first supplemental flap has a curved feature 166, which defines a third depression 165 along an inward facing edge 160 of the first supplemental flap. The first supplemental flap is hingedly coupled at hinge 190 with the first flap such that the third depression 165 matches the first depression 125 when in the stored configuration. The second supplemental flap has a curved feature 181, which defines a fourth depression 180 along an inward facing edge 175 of a second supplemental flap. The second supplemental flap is hingedly coupled at hinge 190 with the second flap such that the fourth depression 180 matches the second depression 145 when in the stored configuration. In the operating configuration the first supplemental flap and second supplemental flap cause a second diameter (FIG. 8) of the base to be larger than the first diameter (FIG. 7). In other words, if you compare diameter D of FIG. 7 and FIG. 8, the diameter in FIG. 8 is larger due to the supplemental flaps being opened.

FIG. 5 depicts the stretching apparatus in a stored configuration. In the stored configuration, the first flap 115 and second flap 135 fold where they are hingedly coupled at hinges 185 so that the first flap and second flap are about perpendicular to the center element 110. The first supplemental flap 155 and the second supplemental flap 170 fold where they are hingedly coupled at hinges 185, so that the supplemental flaps are about parallel with the flaps 115 and 135. Thus, the flaps are used to decrease the size of the apparatus when moving the apparatus into the stored configuration. Comparing FIG. 1 and FIG. 5, the diameter of the base is much larger in the operating configuration than the stored configuration, which allows for more efficient storage when the device is not in use. Thus, the user still has the benefits of the base element, but can still efficiently store the device. Using the base element, as opposed to attaching the housing to the floor or other structure, is beneficial to the user because it decreases the time to set up the device and the user does not have to attach the structure to the floor or wall to use the device. Thus, the user can use the device whenever and wherever the user pleases. The supplemental flaps allow the user to expand the base element even further for a wider stance, while being able to decrease the size of the device in the stored configuration as illustrated in FIG. 5.

Additionally, the depressions 165 and 180 of the supplemental flaps match the depressions 125 and 145 of the flaps, respectively. The handles 215 and 220 of housing 205 are cradled by the depressions 125, 145, 165 and 180. As shown in the figures, the depressions are configured to hold the handles off of the ground while in the stored configuration. In doing so, the stored configuration better protects the handles and housing from potentially being damaged when they are left on the ground. The depressions cradle the handles, which also prevents the housing and handles from rolling around on the floor, which could also lead to a potential hazard or damage to the device. The depressions are semicircular in the figures as shown. However, the depressions may be of any shape, as long as the depressions can hold the handle above the base when in the stored configuration. In other words, other embodiments of the shape and size of the depressions may be used that are within the spirit and scope of the present invention.

As shown in FIGS. 6-8, the apparatus is moved from the stored configuration to the operating configuration, after the user lifts the housing 205 from the depressions 125, 145, 165 and 180. The first flap 115 and second flap 135 unfold where they are hingedly coupled at hinges 185, so that flaps about planar with the center element 110. The supplemental flaps 155 and 170 unfold where they are hingedly coupled at hinges 190, so that the supplemental flaps are about planar with the flaps and the center element. FIG. 8 shows the base in the operating configuration. Using the flaps and supplemental flaps, the user is able to quickly, easily, safely, and efficiently store the apparatus while protecting the housing and maintaining the benefits of having a self-contained device.

The base may be comprised of material such as carbon steel, stainless steel, aluminum, Titanium, other metals or alloys, composites, ceramics, polymeric materials such as polycarbonates, such as Acrylonitrile butadiene styrene (ABS plastic), Lexan™, and Makrolon™. The base may be formed from a single piece or from several individual pieces joined or coupled together. The components of the base may be manufactured from a variety of different processes including an extrusion process, a mold, welding, shearing, punching welding, folding, etc. The base may include a softer foam layer or be made entirely from materials including, but not limited to, rubber, polymeric materials such as plastic, polyvinyl chloride (PVC) plastic, vinyl, and silicone. The grooves depicted in the figures on the base element 105 provide protection from slipping, weight-saving characteristics for additional ease in portability of the stretching apparatus, as well as provide material and cost-saving benefits for the manufacturing process.

The strap element 405 connects the base 105 to the handle 205. The strap can be connected by a looped element 410 as shown. The looped element couples the first end 406 of the strap with the base 105. The strap can also be connected to the base by other methods, such as fasteners or adhesives or may be extruded from the same material as the base. The strap can comprise material such as plastic, leather, cotton, polymer type materials, nylon, webbing, polyester, fabric the center. However, it is understood that other materials may be used and are within the scope of the present invention. The strap is configured to spooled and unspooled on a rotating element (further explained below).

Figure 9:
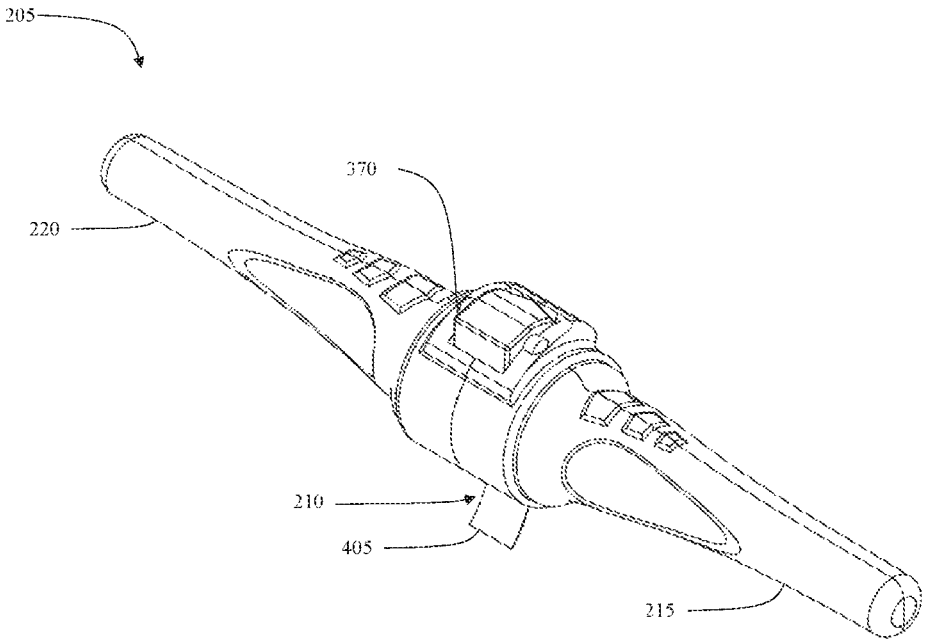
FIG. 9 is a rear perspective view of a portion of the stretching apparatus, according to an example of the embodiment.
Figure 10:
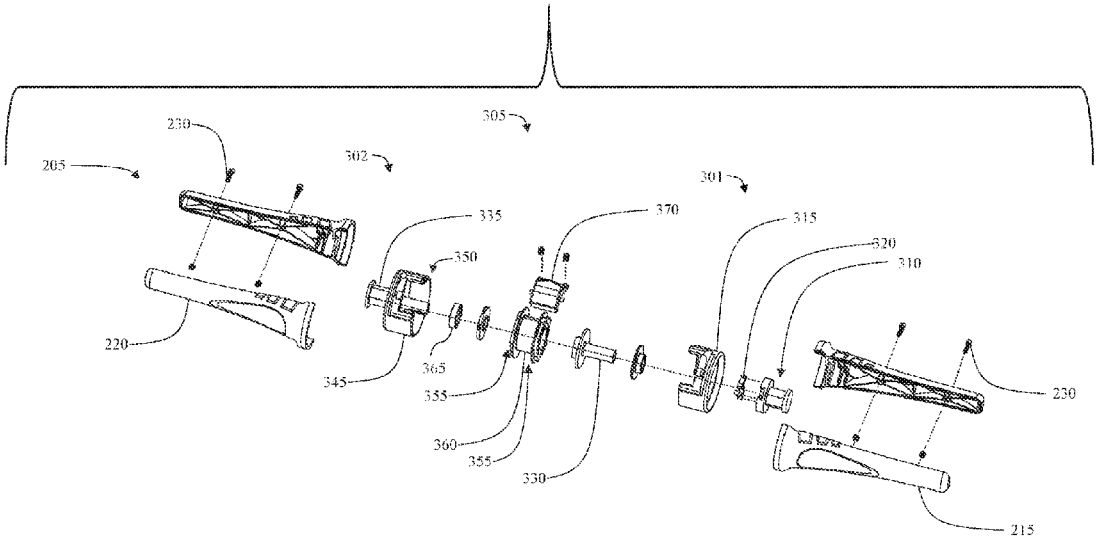
FIG. 10 is an exploded rear perspective view of a portion of the stretching apparatus, according to an example of the embodiment.
Figure 11:
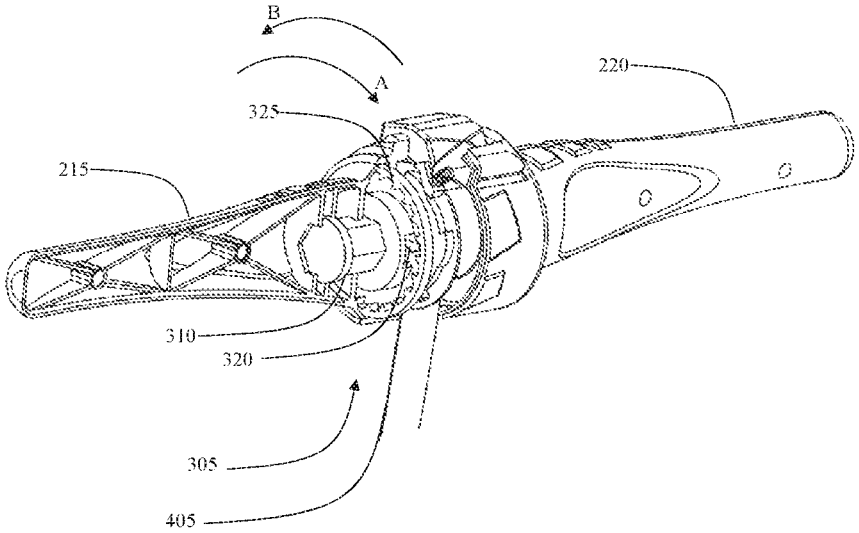
FIG. 11 is a partial cutaway rear perspective view of a portion of the stretching apparatus, according to an example of the embodiment.
Figure 12:
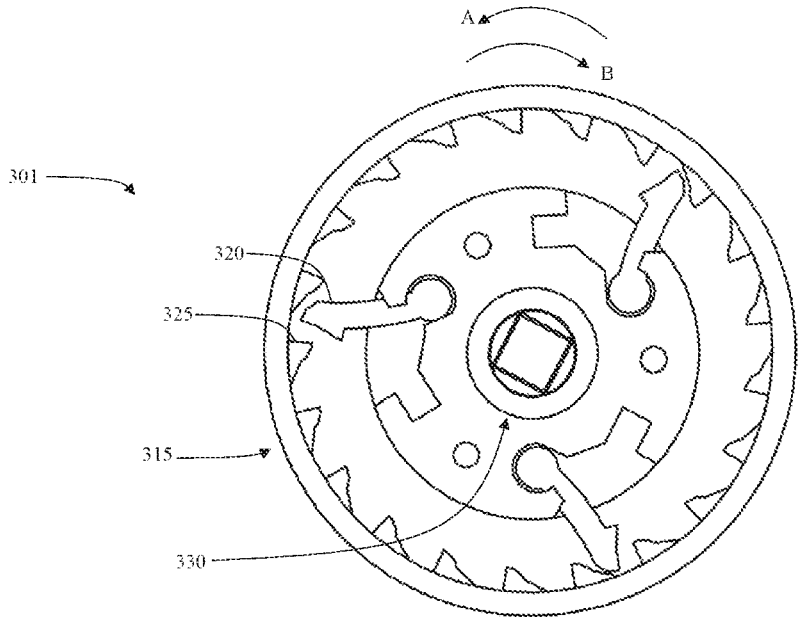
FIG. 12 is a side view of a portion of the stretching apparatus, according to an example of the embodiment.
Figure 13:
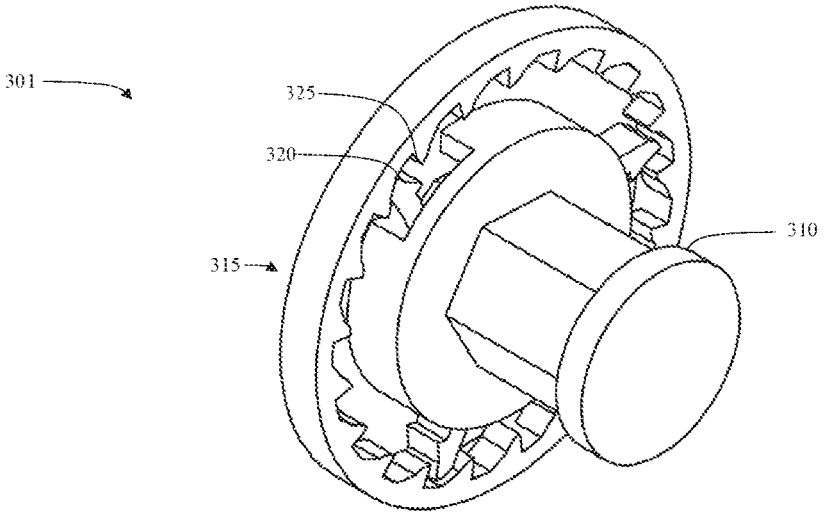
FIG. 13 is a front perspective view of a portion of the stretching apparatus, according to an example of the embodiment.
Figure 14:
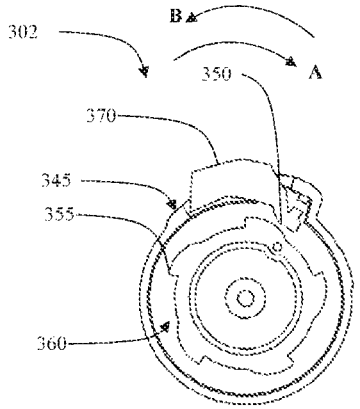
FIG. 14 is a side view of a portion of the stretching apparatus taken along line C of FIG. 15, according to an example of the embodiment.
Figure 15:
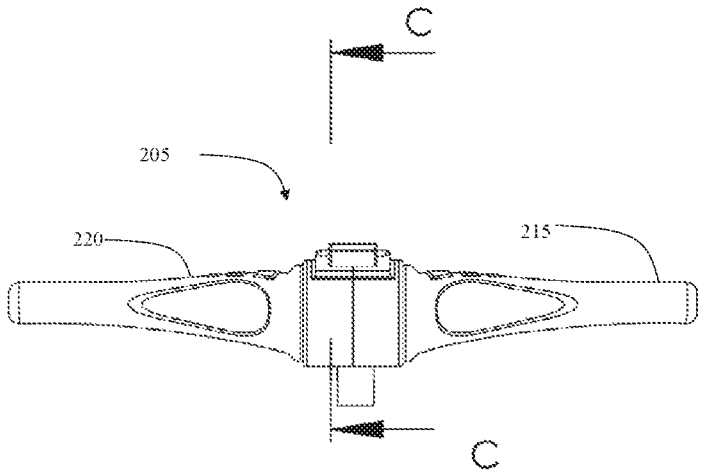
FIG. 15 is a rear view of a portion of the stretching apparatus, according to an example of the embodiment.

FIG. 9 shows the housing 205 and FIG. 10 depicts an exploded view of the housing. The housing defines a strap egress 210, a first handle 215 and a second handle 220. The housing is hollow and contains a ratcheting element 305 as depicted in FIG. 10. The first handle and second handle are configured for to be grasped by hands of a user. The user is able to rotate one of the handles 215 in order to decrease an exposed length of the strap 405 between the base element 105 and the housing 205 so that the handles are moved towards the strap. In the embodiment shown, the opposite handle 220 does not rotate.

The housing may be comprised of material such as carbon steel, stainless steel, aluminum, Titanium, other metals or alloys, composites, ceramics, polymeric materials such as polycarbonates, such as Acrylonitrile butadiene styrene (ABS plastic), Lexan™, and Makrolon™. The housing may be formed from a single piece or from several individual pieces joined or coupled together. The components of the housing may be manufactured from a variety of different processes including an extrusion process, a mold, welding, shearing, punching welding, folding, etc. The housing may include a softer foam layer or be made entirely from materials including, but not limited to, rubber, polymeric materials such as plastic, polyvinyl chloride (PVC) plastic, vinyl, and silicone.

The sides of the handles can be connected by fasteners 230 as shown in FIG. 10. Each of the fasteners may include a, hooks, bolt, set crews, opening configured to attached to protruding element, socket screws u-bolts, twine, etc. However, other types of fasteners may also be used and are within the spirit and scope of the present invention. Other methods may be used including adhesives or using tighter tolerance and pressure to hold the parts together. The adhesive may be a pressure sensitive adhesive comprising materials such as comprise lanolin, mineral oil, petrolatum, rosin, silicone, and zinc oxide. The backing may be made of material, such as wax paper or other materials used to protect adhesive materials.

FIGS. 10-18 show the ratcheting element 305 that allow the user to decrease or increase the exposed length of strap from the handle. The exposed length of the strap is the strap between the housing and the handle that is outside of the handle and visible to a person. The ratcheting element 305 includes a primary ratchet element 301 and a secondary ratchet element 302. The primary ratcheting element is used to ratchet handle 215 towards the base and decrease the exposed length of strap 405 between the base element 105 and the housing 205 so that the handle moves towards the base. In operation, the purpose of the ratcheting element is to allow the user to spool the strap on the rotating element without having to remove his or hands from the hands. This is an improvement over the prior art that allows a user to focus on stretching.

Referring to FIGS. 10-13 for the primary ratchet element 301, a first pawl element 310 engages the first handle 215. In one embodiment, a first side of the first pawl element is a hexagonal shaped object that engages with a catching feature of the handle, but can also be fastened or held together by other means. The stretching apparatus is configured such that as the first handle is rotated it causes the first side of the first pawl element to rotate. A first pawl or first pawls 320 extend outward from the second side of the first pawl element 310. The first pawl element has biasing elements that allow the first pawls to engage with teeth when moved in one direction, but also allow the pawl to be pushed inward when moved in another direction. The use of a biasing element or a compression spring and teeth for ratcheting systems is well known to those skilled in the art.

A first pawl housing 315 includes first pawl teeth 325 that extend inwards that engage the first pawl(s). The orientation of the first pawl teeth within the first pawl housing prevent the first pawl housing from moving in one direction, but allow the handle 215 to ratchet in the opposite direction. In the present embodiment, the orientation of the first pawl teeth and the first pawl prevent the first pawl housing from moving in a first direction relative to the first pawl element when forces in the first direction act on the first pawl element. In other words, when the first pawl element is rotated in the direction represented by line A (FIG. 11), the first pawl engages the first pawl teeth and prevent the first pawl housing from moving relative to the first pawl element. Also, the orientation of the first pawl teeth and the first pawl allow the first pawl element 310 and first pawl housing 315 to rotate relative to each other when force is applied to the first pawl element in the direction represented by line B in FIG. 11 when the apparatus is fully assembled.

A connecting element 330 connects the first pawl housing 315 to the rotating element 360. When the apparatus is fully assembled, the connecting element couples the rotating element to the first pawl housing such that when forces act on the first pawl element in a first direction the connecting element drives the rotating element in the first direction. For example, when forces are applied to the handle in the direction represented by line A in FIG. 11, the first pawl element drives the first pawl housing that is engaged with or coupled to the connecting element. In the present embodiment, the first end of the connecting element connects with first element housing and the second end of the engages with the rotating element. In operation, when handle is rotated in the direction of line A, the first pawl element drives the first pawl element housing to rotate within the housing, which in turn rotates the connecting element in the direction line A, which in turn rotates the rotating element 360.

Figure 16:
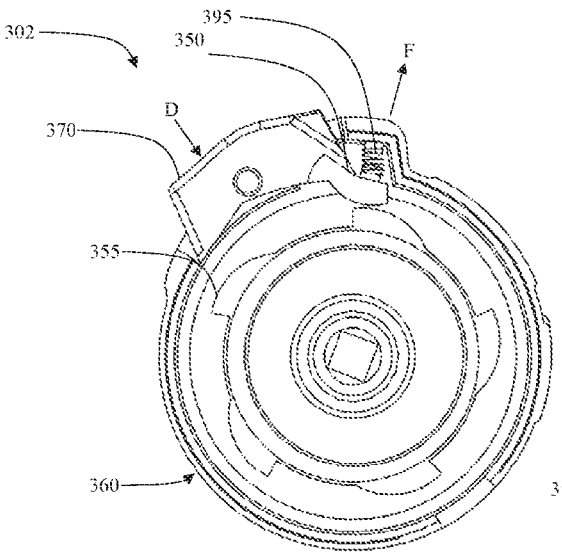
FIGS. 16 and 17 are side views of the stretching apparatus taken along line C of FIG. 15, according to an example of the embodiment.
Figure 17:
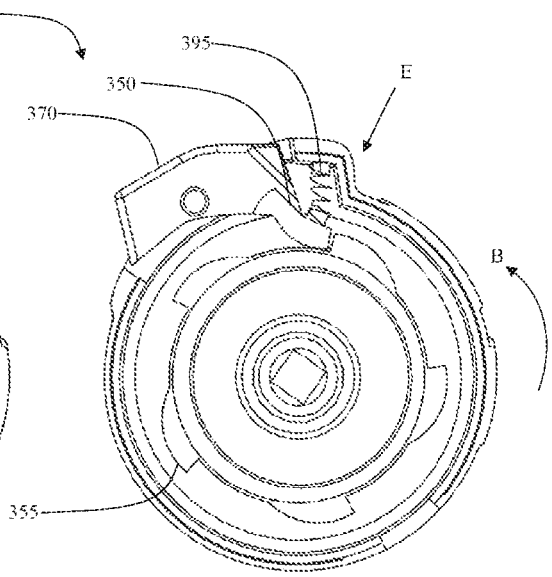
Figure 18:
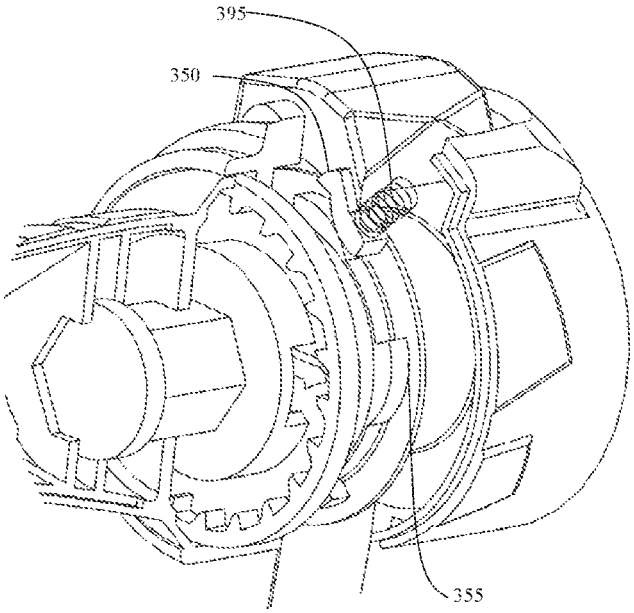
FIG. 18 is a partial cutaway rear perspective view of a portion of the stretching apparatus, according to an example of the embodiment.

The strap 405 is attached to the rotating element 360 in a spool-like manner. Referring to FIGS. 10 and 14-18 for the secondary ratchet system 302. The secondary ratcheting system or element includes a second pawl element having a plurality of second teeth or second pawl teeth 355 positioned along a side of a rotating element. The secondary ratcheting system also includes a second pawl housing 345 having a second pawl 350 extending inward towards the second teeth that extend from the second pawl element. The second pawl engages the second pawl teeth. The orientation of the second pawl teeth and second pawl are configured in such a manner that the second pawl prevents the rotating element moving in a second direction (or in the direction represented by line B) when the second pawl engages the second teeth of the second pawl element (as illustrated in FIG. 17). In operation, when the rotating element rotates in the direction of line A, the orientation of the second pawl teeth and second pawl are such that the rotating element is allowed to rotate freely.

The second pawl 350 is configured to be biased toward the teeth of the second pawl element by a biasing element or a spring 395. The biasing element is configured such that a force in the direction of line E (See FIG. 17) is applied pushing the second pawl to engage the second pawl teeth.

A release control element 370 protrudes outward from the second pawl housing 345 and is in communication with the second pawl. In the present embodiment, the release control element is configured to move the second pawl from an engaged position (See FIG. 17) wherein the second pawl engages the teeth, to a disengaged or free position wherein the second pawl does not engage the second pawl teeth (See FIG. 16). The release control element and second pawl element are mounted on an axle element on the second pawl housing so that when a force in the direction of line D (See FIG. 16) is applied to the release control element, the release control element moves inward causing a force in the direction of line F be applied to the second pawl 350, thereby causing the second pawl 350 to disengage from the second pawl teeth 355 by pushing upwards against the spring 395. When the second pawl 350 is disengaged from the second teeth 355, the rotating element 360 can rotate relative to the second pawl and handle 215.

The stretching apparatus also includes a main biasing element 365. The main biasing element engages the rotating element and positioned such that it provides a force such that rotates the rotating element rotates in the second direction (or in the direction represented by line B). In one embodiment, the main biasing element is a power spring. However, it is understood that the other types of the biasing elements may also be used that are within the spirit and scope of the present invention.

When in the fully assembled configuration, the main biasing element applies a force in the direction of line B facilitating the second teeth to engage with the second pawl. Additionally, when the stretching apparatus is in the fully assembled configuration, and if the second pawl is not engaged with the second teeth (as illustrated in FIG. 16), the main biasing element 365 applies a force in the direction of line B to make it easier for the strap 405 to unspool from the rotating element 360. In operation, if a user wants to increase the length of the strap, the user would apply an inward force to the release control element (in the direction of line D) to disengage the second pawl from the second teeth so that the rotating element may rotate. The force of the main biasing element (in the direction of line B) would facilitate a user to more easily unspool or increase the exposed length of the trap between the base element and housing. In operation, a user may also desire to apply force the handles (in the direction of line G) to facilitate the main biasing element to unspool the strap element from the rotating element and allows the user to increase the exposed length of the strap.

Figure 19:
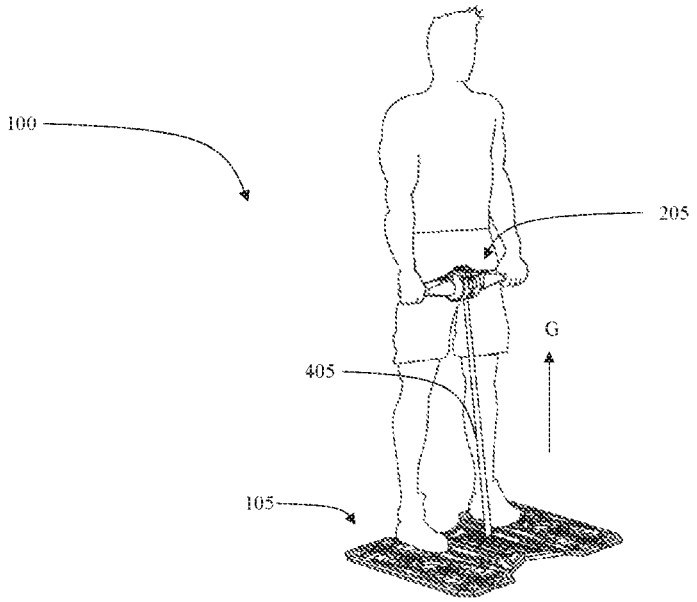
FIG. 19 is a front perspective view of a user using the stretching apparatus, according to an example of the embodiment.
Figure 20:
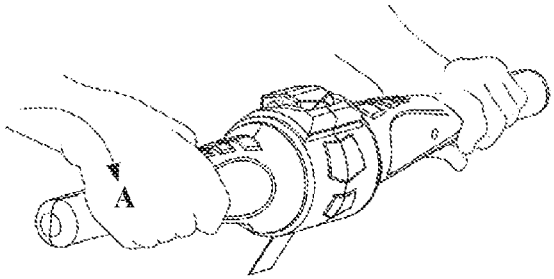
FIGS. 20 and 21 are front perspective views of a user using the stretching apparatus, according to an example of the embodiment.
Figure 21:
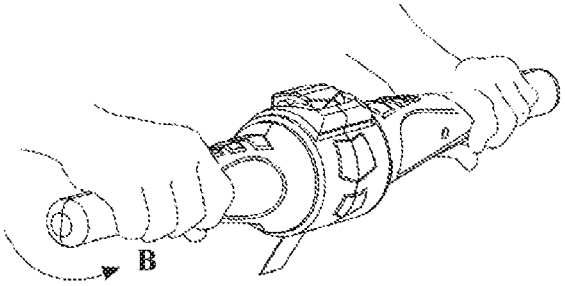
Figure 22:
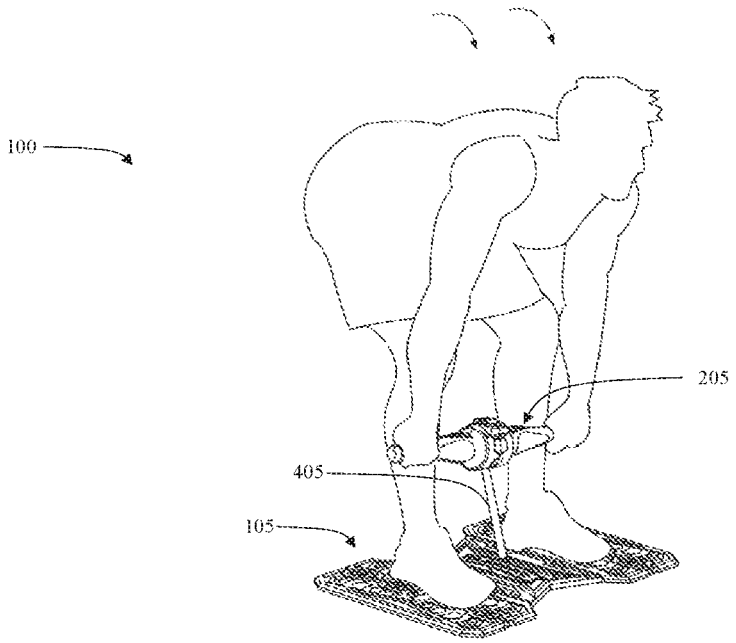
FIG. 22 is a front perspective view of a user using the stretching apparatus, according to an example of the embodiment.

FIGS. 19-22 depict the user using the stretching apparatus. While the stretching apparatus is in the operating configuration, the user places their feet on the base 105, grasps the handles 215 and 220, and extends the strap 405 to a comfortable position using the release control 370. FIG. 19 depicts the user in a standing position or resting position. FIG. 22 depicts the user engaged in the stretch. Move from the standing position to the engaged position as illustrated in FIG. 22, the use will use the ratcheting element to decrease the exposed length of strap between the base element and the housing and so that the strap spools onto the rotating element. Using the ratcheting element 305 contained in the housing 205, the user rotates one handle in a first direction to spool the strap onto the rotating element and decrease the length of the strap 405, pulling the user downwards. As discussed above, the device allows the user to focus on stretching by allowing the user to decrease the exposed length of strap without having to remove his or her arms from the handle. In operation, as the user rotates the first direction (in the direction of line A in FIG. 12), this causes the first pawl element to rotate, which causes the first pawl teeth to engage the first pawl housing and drive the first pawl housing in the first direction. As the first pawl housing rotates in the first direction, the connecting element drives the rotating element to rotate thereby causing the strap to spool on to the rotating element. Next, the user may, without removing his or her hand from the device, rotate the first handle in the second direction (in the direction of line B in FIG. 12). Because of the orientation of the first pawl teeth, first pawl housing, second pawl teeth, and second pawl housing, when the handle is rotated in the second direction, the rotating element does not rotate in the second direction and prevents the strap from unspooling. After rotating the handle in the second direction (or direction of Line B), then the user that rotate the handle in the first direction (in the direction of Line A) to further decrease the length of exposed strap. This ratcheting feature allows a user to keep his or hands on the handles of the stretching apparatus while flexing and bending his or her wrist to decrease the exposed length of the strap and pull the handles towards the base or base element.

To move from the resting position (FIG. 19) to the engaged position (FIG. 22) the user bends at the waist and uses the handle to pull their body deeper into the stretch. When the user reaches a position where the user would like to stay and have a continuous engaged stretched, the handle is automatically locked in place by the second pawl 350 and the second pawl teeth 355.

The handle cannot rotate backwards unless the release control element is used. In operation, if a user would like to increase the length of the exposed length of the strap and unspool the strap from the rotating element, the use will apply force in the direction of line D (See FIG. 16) to the release control element, which causes the release control element to move inward causing a force in the direction of line F be applied to the second pawl 350, thereby causing the second pawl 350 to disengage from the second pawl teeth 355 by pushing upwards against the spring 395. When the second pawl 350 is disengaged from the second teeth 355, the rotating element 360 can rotate relative to the second pawl and handle 215 so that a user may unspool the strap from the rotating element so that the user may move from an engaged position to a resting position.

When the user is finished, the user can step off the base and return the stretching apparatus to the stored configuration or use the release control to extend the strap and start over. The figures show the user using the stretching apparatus while standing. However, the user may perform the exercise in any position, such as sitting or in a recumbent position.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The invention claimed is:

1. A stretching apparatus comprising:

a base element;

a housing defining a strap egress, a first handle and a second handle;

a strap element having a first end and a second end, the first end coupled with the base element, and the second end mounted on a rotating element within the housing such that the strap element can move in and out of the egress;

a ratcheting element for decreasing an exposed length of the strap element between the base element and the housing by rotating one of the handles in a first direction;

the base element having a diameter that is adjustable between an operating configuration and a stored configuration, wherein the base element forms a planar surface when in the operating configuration and holds the housing above the planar surface when the base element is in the stored configuration.

2. The stretching apparatus of claim 1, wherein the ratcheting element comprises:

a first pawl element engaging the first handle and having at least one first pawl extending outward from the first pawl element;

a plurality of first teeth extending inward within the first pawl housing, wherein the first pawl engages the first teeth and prevents the first pawl housing from moving in the first direction relative to the first pawl element when forces in the first direction act on the first pawl element;

a second pawl element having a plurality of second teeth positioned along a side of the rotating element;

a second pawl housing having a second pawl extending inward thereto, wherein the second pawl engages the second teeth and prevents the rotating element moving in a second direction relative to the second pawl housing; and, a connecting element coupling the rotating element to the first pawl housing such that when forces act on the first pawl element in the first direction the connecting element drives the rotating element in the first direction.

3. The stretching apparatus of claim 2 further comprising a main biasing element engaging the rotating element and for biasing the rotating element in the direction.

4. The stretching apparatus of claim 3, wherein the ratcheting element further comprises a release control element protruding outward from the second pawl housing and in communication with the second pawl, wherein the release control element causes the second pawl to disengage from the second pawl teeth when in an inward force is applied thereto.

5. The stretching apparatus of claim 4, wherein the base element comprises:

a center element;

a first flap hingedly coupled with a first side edge of the center element, wherein a first depression along an outward facing edge of the first flap cradles the first handle when in the stored configuration; and, a second flap hingedly coupled with a second side edge of the center element, wherein a second depression along an outward facing edge of the second flap cradles the second handle when in the stored configuration.

6. The stretching apparatus of claim 5, wherein the base element further comprises:

a third depression along an inward facing edge of a first supplemental flap, the first supplemental flap hingedly coupled with the first flap such that the third depression matches the first depression when in the stored configuration;

a fourth depression along an inward facing edge of a second supplemental flap, the second supplemental flap hingedly coupled with the second flap such that the fourth depression matches the second depression when in the stored configuration; and, wherein in the operating configuration the first supplemental flap and second supplemental flap form a second diameter of the base larger than the first diameter.

7. The stretching apparatus of claim 1, wherein the first handle and second handle are configured to be grasped by hands of a user.

8. The stretching apparatus of claim 1, wherein a looped element couples the first end of the strap element with the base.

9. A stretching apparatus comprising:

a base element having a center element, a first flap hingedly coupled with a first side edge of the center element, wherein a first depression along an outward facing edge of the first flap cradles the first handle when in a stored configuration, and a second flap hingedly coupled with a second side edge of the center element, wherein a second depression along an outward facing edge of the second flap cradles the second handle when in a stored configuration;

a housing defining a strap egress, a first handle and a second handle;

a strap element having a first end and a second end, the first end coupled with the base element, and the second end mounted on a rotating element within the housing such that the strap element can move in and out of the egress; and a ratcheting element for decreasing an exposed length of the strap element between the base element and the housing by rotating one of the handles in a first direction.

10. The stretching apparatus of claim 9, wherein the ratcheting element comprises:

a first pawl element engaging the first handle and having at least one first pawl extending outward from the first pawl element, a plurality of first teeth extending inward within the first pawl housing, wherein the first pawl engages the first teeth and prevents the first pawl housing from moving in the first direction relative to the first pawl element when forces in the first direction act on the first pawl element;

a second pawl element having a plurality of second teeth positioned along a side of the rotating element, a second pawl housing having a second pawl extending inward thereto, wherein the second pawl engages the second teeth and prevents the rotating element moving a second direction relative to the second pawl housing; and, a connecting element coupling the rotating element to the first pawl housing such that when forces act on the first pawl element in the first direction the connecting element drives the rotating element in the first direction.

11. The stretching apparatus of claim 10 further comprising a main biasing element engaging the rotating element and for biasing the rotating element in the second direction.

12. The stretching apparatus of claim 11, wherein the ratcheting element further comprises a release control element protruding outward from the second pawl housing and in communication with the second pawl, wherein the release control element causes the second pawl to disengage from the second pawl teeth when if an inward force is applied thereto.

13. The stretching apparatus of claim 10, wherein the base element further comprises:

a third depression along an inward facing edge of a first supplemental flap, the first supplemental flap hingedly coupled with the first flap such that the third depression matches the first depression when in the stored configuration;

a fourth depression along an inward facing edge of a second supplemental flap, the second supplemental flap hingedly coupled with the second flap such that the fourth depression matches the second depression when in the stored configuration; and, wherein in the operating configuration the first supplemental flap and second supplemental flap form a second diameter of the base larger than the first diameter.

14. A stretching apparatus comprising:

a base element;

a housing defining a strap egress, a first handle and a second handle;

a strap element having a first end and a second end, the first end coupled with the base element, and the second end mounted on a rotating element within the housing such that the strap element can move in and out of the egress;

a ratcheting element for decreasing an exposed length of the strap element between the base element and the housing by rotating one of the handles in a first direction;

a release control element for increasing the exposed length of strap between the base element and the housing by applying an inward force thereto; and, the base element having a diameter that is adjustable between an operating configuration and a stored configuration, wherein the base element forms a planar surface when in the operating configuration and holds the housing above the planar surface when the base element is in the stored configuration.

15. The stretching apparatus of claim 14, wherein the ratcheting element comprises:

a first pawl element engaging the first handle and having at least one first pawl extending outward from the first pawl element;

a plurality of first teeth extending inward within the first pawl housing, wherein the first pawl engages the first teeth and prevents the first pawl housing from moving in the first direction relative to the first pawl element when forces in the first direction act on the first pawl element;

a second pawl element having a plurality of second teeth positioned along a side of the rotating element, a second pawl housing having a second pawl extending inward thereto, wherein the second pawl engages the second teeth and prevents the rotating element moving in a second direction relative to the second pawl housing; and, a connecting element coupling the rotating element to the first pawl housing such that when forces act on the first pawl element in the first direction the connecting element drives the rotating element in the first direction.

16. The stretching apparatus of claim 14, wherein the base element comprises:

a center element;

a first flap hingedly coupled with a first side edge of the center element, wherein a first depression along an outward facing edge of the first flap cradles the first handle when in the stored configuration; and, a second flap hingedly coupled with a second side edge of the center element, wherein a second depression along an outward facing edge of the second flap cradles the second handle when in the stored configuration.

17. The stretching apparatus of claim 16, wherein the base element further comprises:

a third depression along an inward facing edge of a first supplemental flap, the first supplemental flap hingedly coupled with the first flap such that the third depression matches the first depression when in the stored configuration;

a fourth depression along an inward facing edge of a second supplemental flap, the second supplemental flap hingedly coupled with the second flap such that the fourth depression matches the second depression when in the stored configuration; and, wherein in the operating configuration the first supplemental flap and second supplemental flap form a second diameter of the base larger than the first diameter.

18. The stretching apparatus of claim 14, wherein the stretching apparatus further comprises a main biasing element engaging the rotating element and for biasing the rotating element in the second direction.

* * * * *